US010808703B2

(12) United States Patent
Mikkelsen et al.

(10) Patent No.: US 10,808,703 B2
(45) Date of Patent: Oct. 20, 2020

(54) MULTI-STAGE CENTRIFUGAL PUMP HAVING TIE RODS FORMED FROM SHEET METAL

(71) Applicant: GRUNDFOS HOLDING A/S, Bjerringbro (DK)

(72) Inventors: Steen Mikkelsen, Bjerringbro (DK); Niels Due Jensen, Bjerringbro (DK); Brian Lundsted Poulsen, Langå (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 7 days.

(21) Appl. No.: 16/060,215

(22) PCT Filed: Dec. 7, 2016

(86) PCT No.: PCT/EP2016/080043
§ 371 (c)(1),
(2) Date: Jun. 7, 2018

(87) PCT Pub. No.: WO2017/102491
PCT Pub. Date: Jun. 22, 2017

(65) Prior Publication Data

US 2018/0363659 A1 Dec. 20, 2018

(30) Foreign Application Priority Data

Dec. 17, 2015 (EP) ..... 15200756

(51) Int. Cl.
*F04D 1/06* (2006.01)
*F04D 29/42* (2006.01)
*F04D 29/62* (2006.01)

(52) U.S. Cl.
CPC ..... *F04D 1/066* (2013.01); *F04D 29/426* (2013.01); *F04D 29/628* (2013.01); *F05D 2230/54* (2013.01)

(58) Field of Classification Search
CPC ..... F04D 1/066; F04D 29/426; F04D 29/628; F04D 29/605; F05D 2230/54;
(Continued)

(56) References Cited

U.S. PATENT DOCUMENTS 4,339,105 A * 7/1982 Witt ..... H01G 2/04 180/68.5
5,201,633 A * 4/1993 Peu ..... F04D 1/066 137/565.33

(Continued)

FOREIGN PATENT DOCUMENTS

CN 101624990 A 1/2010
DE 34 10 080 C1 7/1985

(Continued)

OTHER PUBLICATIONS

EPO English Language Machine translation of Fritsch et al. DE 3410080.*

*Primary Examiner* — Moshe Wilensky
*Assistant Examiner* — Andrew Thanh Bui
(74) *Attorney, Agent, or Firm* — McGlew and Tuttle, P.C.

(57) ABSTRACT

A multistage centrifugal pump has a foot part (2) and a head part (9), between which pump stages are integrated. The head part (9) and the foot part (2) are connected via tie-rods (11) which with one end are fastened on the head part (9) and with the other end are fastened on the foot part (2). The tie-rods (11) at one end comprise a thread (14), with which they are tightened on the head part (9). The tie-rods (11) are formed from sheet metal. At the end opposite the thread, the tie-rods include a recess, with which recess the tie-rods are each positively fixed on the foot part (2), at least in the tensile direction (22).

20 Claims, 13 Drawing Sheets

(58) Field of Classification Search
CPC ..... F05D 2002/0254; F05D 2002/0215; E04B 2002/0254; E04B 2002/0215; F16B 35/04
See application file for complete search history.

(56) References Cited

U.S. PATENT DOCUMENTS

| | | | | |
|---|---|---|---|---|
| 8,172,523 | B2 | 5/2012 | Towsley et al. | |
| 8,485,780 | B2 * | 7/2013 | Vedsted | F04D 29/426 415/214.1 |
| 10,030,915 | B2 * | 7/2018 | Alessandrini | F24H 9/02 |
| 2008/0019831 | A1 * | 1/2008 | Kajiwara | F04D 7/06 415/214.1 |
| 2009/0214332 | A1 | 8/2009 | Towsley et al. | |
| 2013/0164125 | A1 | 6/2013 | Mikkelsen | |
| 2014/0093409 | A1 * | 4/2014 | Tazioli | F04D 29/406 417/423.11 |

FOREIGN PATENT DOCUMENTS

| | | | |
|---|---|---|---|
| DE | 29817337 | U1 | 12/1998 |
| EP | 2 143 959 | A1 | 1/2010 |
| JP | 2001 041187 | A | 2/2001 |
| JP | 2003 172285 | A | 6/2003 |
| RU | 2556948 | C2 | 7/2015 |

* cited by examiner

MULTI-STAGE CENTRIFUGAL PUMP HAVING TIE RODS FORMED FROM SHEET METAL

CROSS REFERENCE TO RELATED APPLICATIONS

This application is a United States National Phase Application of International Application PCT/EP2016/080043, filed Dec. 7, 2016, and claims the benefit of priority under 35 U.S.C. § 119 of European Application 15 200 756.3, filed Dec. 17, 2015, the entire contents of which are incorporated herein by reference.

FIELD OF THE INVENTION

The invention relates to a multi-stage centrifugal pump with a foot part, with a head part and with pump stages which are integrated therebetween.

BACKGROUND OF THE INVENTION

Such centrifugal pumps are known in numerous design variants, and, with regard to this, the Grundfos CR series, which is available on the market in different construction sizes, is referred to. Common to these pumps is the fact that they comprise a foot part with which, on operation, they stand on the ground or a foundation provided for this, as well as a head part which is designed as a motor stool (support) or is provided for receiving a motor stool, via which a drive motor for the pump can be connected. These pumps are designed as inline pumps and in the foot part comprise a suction connection as well as a delivery connection. The pump stages are arranged above one another, wherein the last pump stage is connected to the delivery connection in the foot part via an annular channel which surrounds the pump stages, and tie-rods which connect the head part and foot part to one another and which with one end are fixed to the head part and with the other end to the foot part are arranged on the outer channel wall. Hereby, it is therefore the case of pumps, with which the actual centrifugal pump and the drive motor form essentially independent assemblies which are coupled in movement to one another in the region of the motor stool. Thereby, standard motors are typically applied, wherein these are not especially designed for these pumps, but can also be applied in other drive applications. This centrifugal pump with regard to design must therefore be designed such that, standing on the ground, it can accommodate the drive motor fastened on the head part and its reaction forces. The centrifugal pumps are thereby designed in construction series, whose head parts and foot parts in each case correspond to one another, but however differ regarding the number of pump stages arranged therebetween.

With known centrifugal pumps of this type, the pump stages are integrated between the head part and the foot part, wherein the head part and the foot part are connected to one another via tie-rods which provide the pump with mechanical retention. For this, as a rule, four tie-rods which are distributed symmetrically around the periphery of the pump stages, are formed from round material and at the ends are provided with an outer thread are provided. These tie-rods are either fastened in threaded holes of the foot part or are fastened there byway of nuts, wherein the free ends of the tie-rods at the head part side are led through corresponding bores in the head part and are fixed there via nuts. Thus pump stages which are integrated between the head part and the foot part are clamped to one another via these tie-rods, by which means the complete construction obtains its stability.

The disadvantage with multistage centrifugal pumps of this type is the fact that the tie-rods are quite difficult to assembly. Thus these must firstly be firmly screwed in the foot part, whereupon the connection to the head part is effected and finally the nuts on the head part side are applied and are tightened with the necessary torque. These screw-like tie-rods are moreover expensive and heavy. They project laterally with respect to the cylindrical pump body in a significant manner, so that they always also form engagement surfaces, on which one can quite easily snag with a tool or also other objects. Moreover, bending moments on the head part and foot part and which can lead to undesired deformation moreover become effective due to the lateral projection beyond the pump body. On the other hand, these tie-rods must accommodate considerable forces, since the head part or the motor stool must carry the electric motor. Furthermore, the tie-rods can be subjected to additional forces due to thermal expansion if the surrounding temperature and the temperature of the delivery fluid noticeably differ from one another.

SUMMARY OF THE INVENTION

Against this background, it is an object of the invention to improve a multistage centrifugal pump of the initially mentioned type, with regard to the tie-rods and the fastening of tie-rods.

The multistage centrifugal pump according to the invention comprises a foot part and a head part, between which pump stages are integrated. The pump is configured as an inline pump with a suction connection and a delivery connection in the foot part, wherein the pump stages are surrounded by an annular channel, by way of which the last pump stage is connected to the delivery connection and on whose outer channel wall tie-rods are arranged, said tie-rods connecting the head part and the foot part to one another and being fixed with one end to the head part and with the other end to the foot part. Herein, the tie-rods are each provided with a thread at one end, with which thread they are tightened on the head part or on the foot part. According to the invention, the tie-rods at least in sections are formed from sheet metal and are fastened to the other end at the head side or foot side.

Basically, it is of no relevance as to whether the positive connection by way of the recess is effected at the foot part side, and the screw connection at the head part side, or vice versa, but since the head part is more easily accessible, as a rule it is simpler to provide the screw connection on the head part side.

Thereby, one is to take into account the fact that the centrifugal pumps of the type discussed here comprise a foot part, with which they stand on the ground or a foundation, which is to say a component which carries the complete pump as well as the motor which is attached thereto.

According to the invention, the tie-rods at least in sections are formed from sheet metal, preferably completely of sheet metal, with the exception of the threaded part at one end. The tie-rods should be formed from sheet metal as much as possible, which is to say the threaded part should be configured as short as is necessary. The sheet metal part should thus bridge the complete region between the head part and the foot part or end directly in front of the head part or foot part where the threaded part then connects. Such tie-rods formed from sheet metal can be inexpensively manufactured, for example by way of laser cutting or punching, which is particularly advantageous with large piece numbers. The tie-rods are advantageously configured as one piece, i.e. the threaded part is advantageously welded onto the part which is formed from sheet metal. The sheet metal section can be formed from one or more sheet metal sections which are connected to one another for example by way of welding.

According to an advantageous further development of the invention, the fixation of the tie-rods at their other ends is effected via at least one projection, with which these are positively fixed on or in the foot part and on or in the head part respectively, at least in the tensile direction. Herein, the fixation, preferably to the foot part, is effected such that the thread is arranged at the head part side and is screwed there to the nut. The design of the tie-rods predominantly of sheet metal further has the advantage that these can be adapted to the outer contour of the pump stages, by which means the radial construction size can be significantly reduced in the region of the pump stages. The moment loads of the head part and foot part can also be significantly reduced with designs according to the state of the art by way of this. Moreover, the design of the tie-rods from sheet metal also permits an aesthetically significantly more pleasant design than was the case according to the state of the art, with which the clamping bolts project radially in the manner of a foreign body. Finally, the design of the tie-rods of sheet metal permits these to be arranged in a manner bearing on the annular channel wall, which entails the huge advantage of the tie-rods being thermally connected to the delivery fluid which flows through the annular channel, on account of the surfaced contact, so that thermally created stresses are significantly reduced.

The dimensioning of the tie-rods is dependent on the forces to be accommodated and the tensile strength of the applied material. However, advantageously they should at least be configured such that an intrinsic stability of the tie-rods is given. This for example can also be assisted by way of the tie-rods having a curvature which is adapted to the curvature of the pump body, thus being arcuately bent about their longitudinal axis. Such a curvature permits the tie-rods to be applied onto the pump body which is formed in the region of the pump stages, practically without any distance, so that these have the same temperature level as the pump body, which is particularly advantageous.

The projection at the other end of the tie-rod is advantageous formed by a sheet metal part which is connected to the part of the tie-rod which is formed from sheet metal, by way of welding. Such a design has the advantage that the tie-rod over its longitudinal extension can be optimized with regard to the forces which are to be accommodated, so that no additional material occurs in the region of the channel wall of the annular space over the longitudinal extension for the positive fixation, but merely where the positive fit is necessary for the fixation, thus the projection for the fixation must be formed. This projection is formed by a separate sheet metal part and is connected to the other part of the tie-rod which is formed from sheet metal, by way of welding. Herein, it is particularly advantageous if the sheet metal section which forms the projection embraces the end of the tie-rod which is formed from sheet metal, at three sides in a U-shaped configuration, i.e. surrounds it radially to the outside and at both peripheral sides. At least one opening, through which a weld seam permitting a uniform introduction of forces from the sheet metal part which forms the projection, onto the end of the tie-rod, can be incorporated, is advantageously provided in the sheet metal part which is to be welded on, in order to herein ensure a simple and simultaneously secure weld connection.

Alternatively, according to the invention, one envisages forming the at least one projection by way of an edge recess in the sheet metal, so that a projection in the peripheral direction with respect to this edge recess results at the end. Such a recess has the advantage that no further component needs to be attached at the other end, but this end is defined by the shaping of the sheet-metal part itself.

The fixation of the end which is formed from sheet metal, according to the invention is effected by way of at least one rod recess on the foot part or head part. Recesses which are provided and envisaged for the positive fixation, thus for anchoring the end of a tie-rod which is formed from sheet metal are hereinafter indicated as a rod recess. In contrast to this, the recesses in the end of the tie-rod which is formed from sheet metal are hereinafter only indicated as recesses. Recesses in the head part and in which the head-part-side ends of the tie-rods are fixed are hereinafter indicated as hole recess. Thereby, it can be the case of holes, bores or also laterally open recesses.

It is particularly advantageous if, according to a further development of the invention, the tie-rods each comprise a recess at least on one longitudinal side, for forming a projection. A positive fixation in the head part or foot part can then be effected by way of the design of a suitable rod recess which has a region, in which the tie-rod can be inserted, and a further region, at which a counter-part engages into this recess. This condition can be achieved for example by way of pivoting, transverse displacement or rotation.

It is particularly advantageous if lateral recesses are provided on both longitudinal sides of the tie-rod, preferably at the same height, for forming projections, since a particularly uniform force transmission into the tie-rod is then effected.

In a corresponding manner, the fixation of a tie-rod, whose projection is attached by way of welding, is effected in a rod recess, in which the tie-rod is laterally displaced after leading through the projection and, as yet described further below, is secured in this position by way of suitable design measures.

Basically, it is also conceivable to form the end of the tie-rod which is provided with the thread of sheet metal, by way of further material being applied on the sheet metal main body either by way of folding or depositing further material, into which material a thread is then cut or embossed. According to a further development of the invention, one however advantageously envisages providing the tie-rods at their end provided with the thread with a threaded bold which is connected to the part of the tie-rod formed from sheet metal by way of welding.

According to the invention, hole recesses are provided, through which the ends of the tie-rods provided with the thread are led and there are fixed and tightened by way of a nut in each case, in order to fix the end of the tie-rod which is provided with the thread, in the head part or foot part. This fastening is advantageously effected at the head part side, wherein the head part is advantageously configured as a motor stool (support). Thereby, it is therefore the case then of the same component which not only closes the pump stages to the top, but which also simultaneous forms the motor receiver, thus a motor stool. The hole recesses can be laterally open, so that it is not necessary to insert the ends of the tie-rods which are provided with the thread through these, but that these can also be inserted from the side for example. In particular, this simplifies the automated assembly.

It is particularly advantageous if the head part which simultaneously also forms the motor stool is configured and arranged such that the tie-rods reach up to the motor stool and are fixed there, wherein supports are advantageously provided at the head part side in the intermediate region, said supports radially inwardly supporting the tie-rods in this region.

The part of the pump which is clamped or tensioned between the foot part and head part comprises a cylindrical section, for example formed by a tube, which forms the return channel from the delivery side to the foot part. According to a further development of the invention, one envisages the parts of the tie-rods which are formed from sheet metal being adapted to the curvature of this cylindrical section, which is to say being deformed about their longitudinal axis. Such a deformation permits the tie-rods to be applied onto the cylindrical section, which is thermally particularly advantageous and creates a slim optical impression.

Rod recesses which each comprise an introduction part and a holding part, are preferably provided in the foot part, for the positive integration of the ends of the tie-rods. The introduction part is thereby configured such that an end of a tie-rod which is formed from sheet metal can be led through this introduction part and specifically so far, until the recesses on the longitudinal sides lies within the rod recesses. A tie-rod with its sheet-metal-side end by way of displacing or pivoting can then be brought from the introduction part of a rod recess into the holding part, in which the tie-rod is positively held by the projections at least in the direction of its longitudinal axis and in which the material surrounding the rod recess engages laterally into the recesses of the end of the tie-rod, said end being on the sheet metal part side. Thereby, the bringing from the introduction part into the holding part can advantageously be effected by way of radial displacement or in a simple manner by way of pivoting, as will yet be described in detail further below.

The rod recesses are thereby advantageously configured such that the holding parts connect radial outwards to the introduction parts, such that the cylindrical section of the component surrounding the pump stages positively secures the ends of the tie-rods which lie in the holding parts of the rod recesses, so that they can no longer get into the region of the introduction parts, into which they can be inserted or stuck for assembly and disassembly purposes. If the projections at the ends of the tie-rods are formed by welding sheet-metal parts, then the rod recesses are to be configured such that although the ends of the tie-rods which are provided with the projections can pass through them, they can however be brought into a positive fit with the edge of the rod recess by way of radially displacing the tie-rod ends, wherein hereby the ends of the tie-rods positively secure the cylindrical section of the component which surrounds the pump stages.

It is particularly advantageous if the rod recesses are arranged circularly around the longitudinal middle axis of the pump, preferably in the foot part, and their introduction parts are covered by a component of the pump, for example a pump stage or the peripheral jacket, for the positive fixation of the tie-rod located in the holding part. The tie-rods are advantageously arranged symmetrically about the longitudinal middle and rotation axis of the pump, and three, four or more tie-rods can be provided.

With regard to the design, it is particularly advantageous if the rod recesses are arranged in an axial wall, preferably of the foot part. With this arrangement, the actual foot part can consist of a plate which for example is manufactured from cast metal and a part which connects thereto to the top either likewise formed of cast metal, thus configured as a single piece component with the plate, or as a sheet metal design as the case may be.

According to an alternative design of the invention, the introduction parts of the rod recesses are arranged in a radial wall, and the holding parts of the rod recess are arranged in an axial wall, preferably of the foot part. Such an arrangement has the advantage that the tie-rods can be inserted from the side and be positively fixed by way of pivoting for example. A very simple and simultaneously reliable assembly results by way of this. Thereby, the holding parts of the rod recess can alternatively also be provided in a suitable recess or opening in the radial wall, typically in its peripheral side.

Advantageously, the head part as well as the foot part is configured as a metallic cast part, wherein the foot part is configured for the placement of the pump on a foundation, typically on the floor, and the head part is configured for receiving an electric motor which drives the pump. These components can then be used for a complete series of pumps, wherein it is only the tie-rods and the pumps stages integrated therebetween or the surrounding tube forming the return channel, which need to be accordingly adapted to the number of the pump stages. The pump is thereby advantageously configured as an inline pump and comprises a suction connection and a delivery (pressure) connection in the foot part, wherein the pump stages are surrounded by an annular channel, by way of which the last pump stage is connected to the delivery connection in the foot part and on whose outer channel wall the tie-rods are arranged, either preferably bearing on this or at a small distance to it. Thereby, the foot part with its suction connection and delivery connection can be configured as a cast part, but for example also only a plate forming the actual foot part can be constructed of cast metal and the remainder of the foot part of sheet metal.

It is particularly favorable if the tie-rods are formed from sheet metal with the exception of the end part provided with the thread, thus if the sheet metal part of the tie-rod extends from the foot part to the head part or to directly in front of this. On the one hand an inexpensive manufacture and on the other hand a design which is to be preferred optically and technically can be realized by way of this, with which the tie-rods bear on the pump body which is otherwise cylindrical there, in an almost flush manner. It is particularly advantageous if the tie-rods are configured as one piece and in particular also in an intrinsically stable manner, since these can then be integrated into a largely automated assembly processes in a relatively simple manner. This of course also applies to the projections which are welded to the ends of the tie-rods and which are then formed with the respective tie-rod.

The foot part advantageously comprises a pot-like structure, wherein the rod recesses are then advantageously arranged where the pot base merges into the pot wall. The introduction part of the rod recesses can then be provided in the wall for example and the holding part in the base. The rod recess then extends in both regions. If the foot part leads fluid and the inner side of the pot wall cannot be provided with rod recesses for this reason, the pot base can then project radially beyond the pot wall, in order to accordingly arrange rod recesses at the outer side.

The invention is hereinafter explained in more detail by way of an embodiment example represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
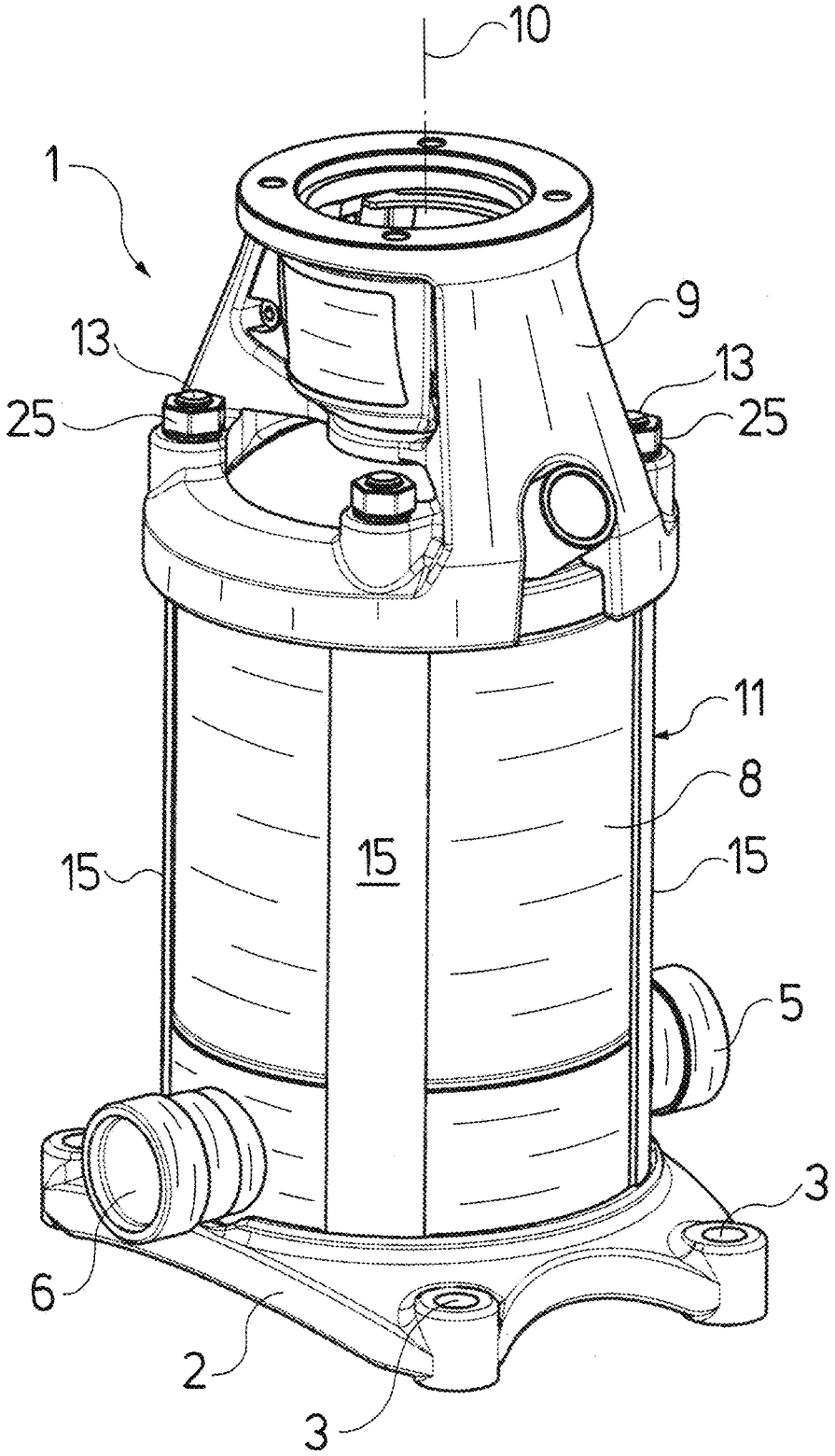
FIG. 1 is a greatly simplified perspective representation of a first embodiment of a centrifugal pump according to the invention.
Figure 2:
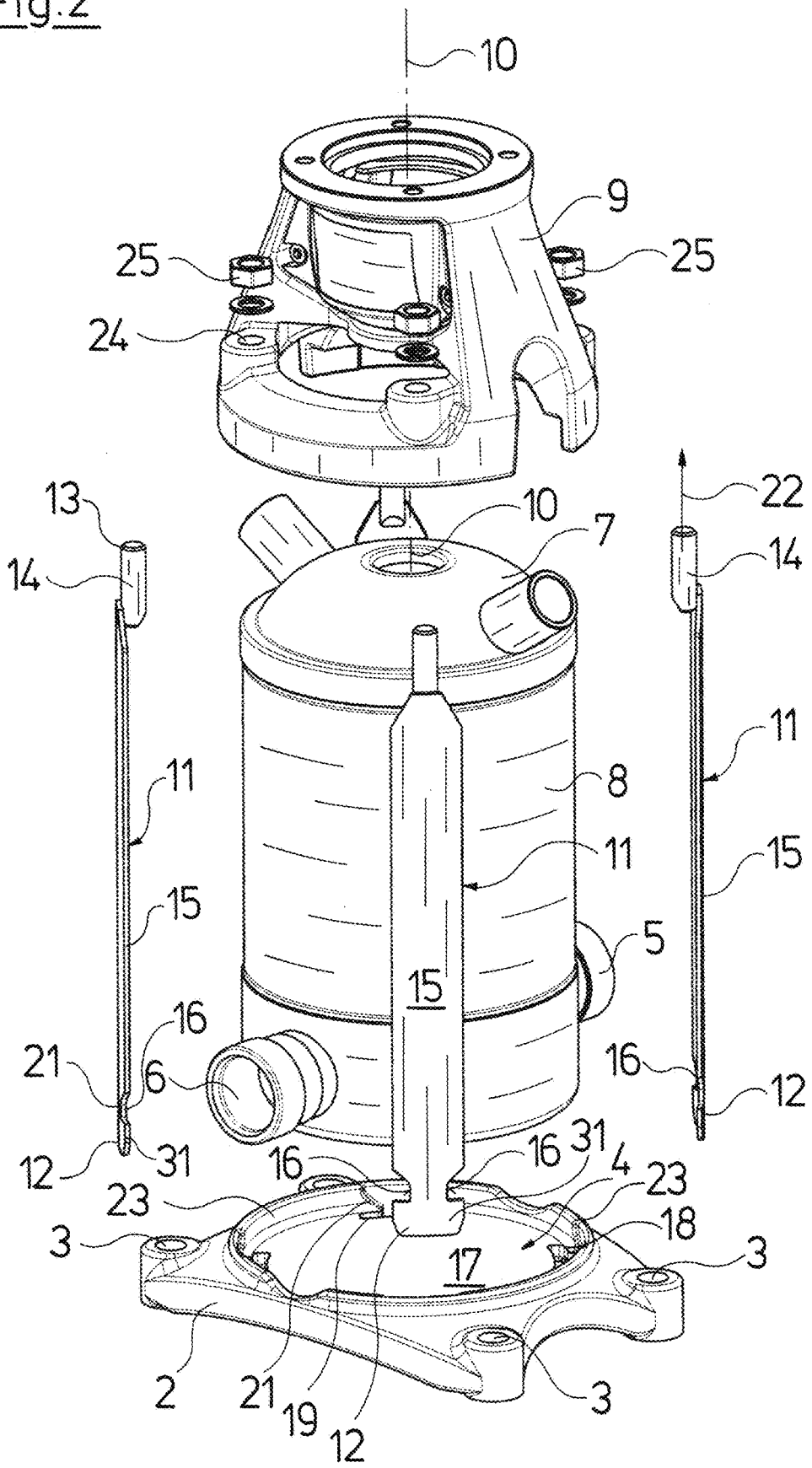
FIG. 2 is an exploded representation of the centrifugal pump according to FIG. 1.
Figure 3:
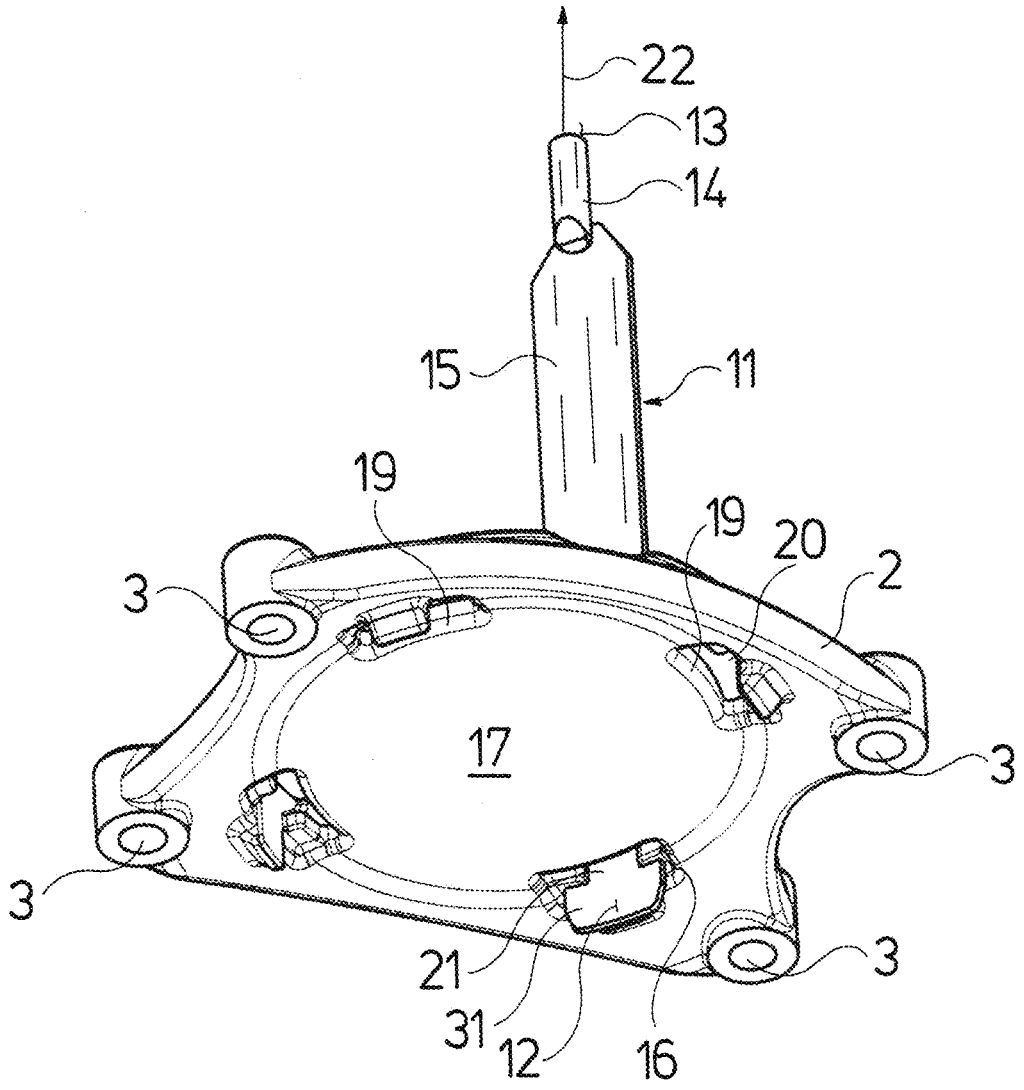
FIG. 3 is a bottom perspective view, from below with a fixed tie-rod, of the foot part of the pump according to FIG. 1.
Figure 11:
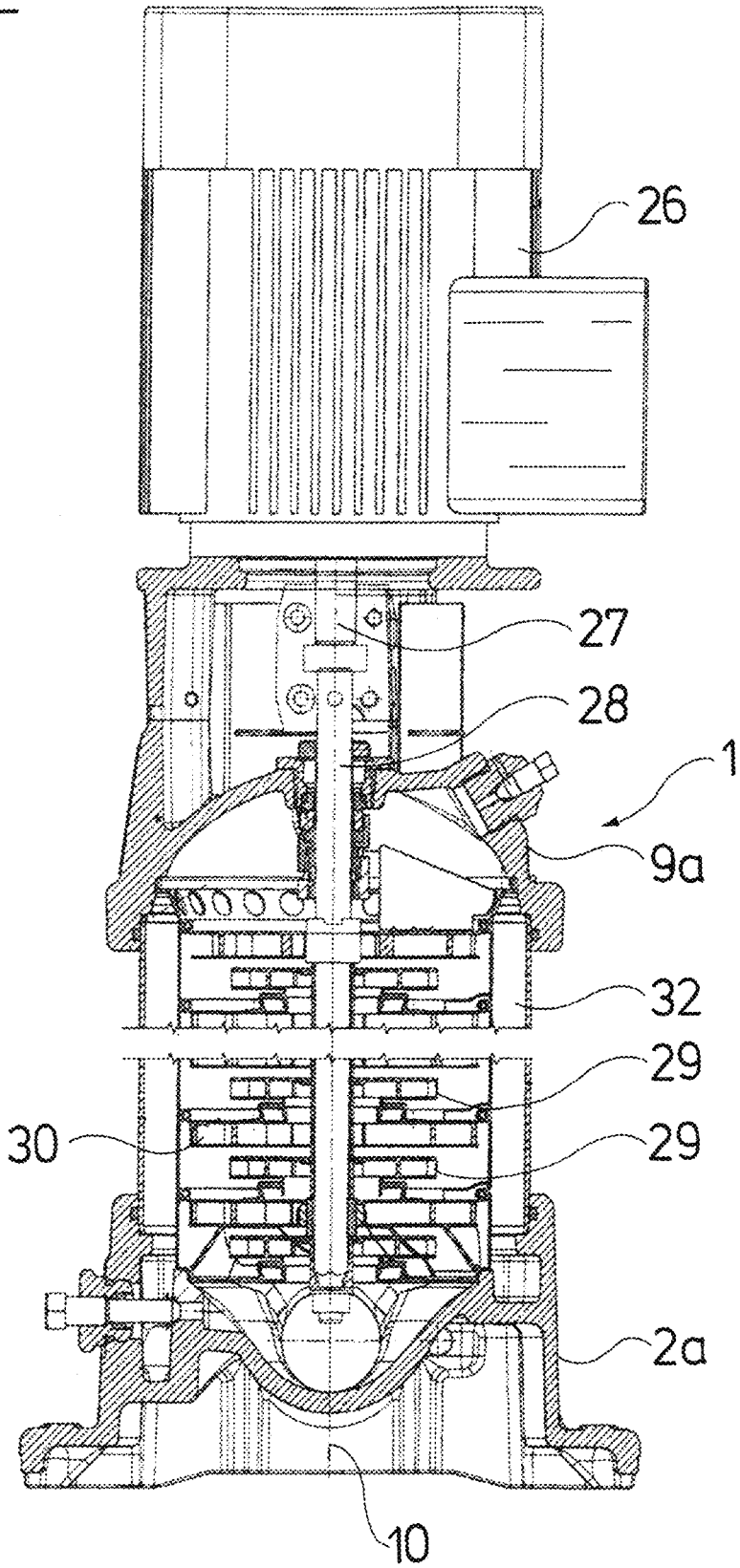
FIG. 11 is a lateral partially longitudinal sectional view illustrating the design construction of a comparably constructed centrifugal pump with a connected electric motor.
Figure 12:
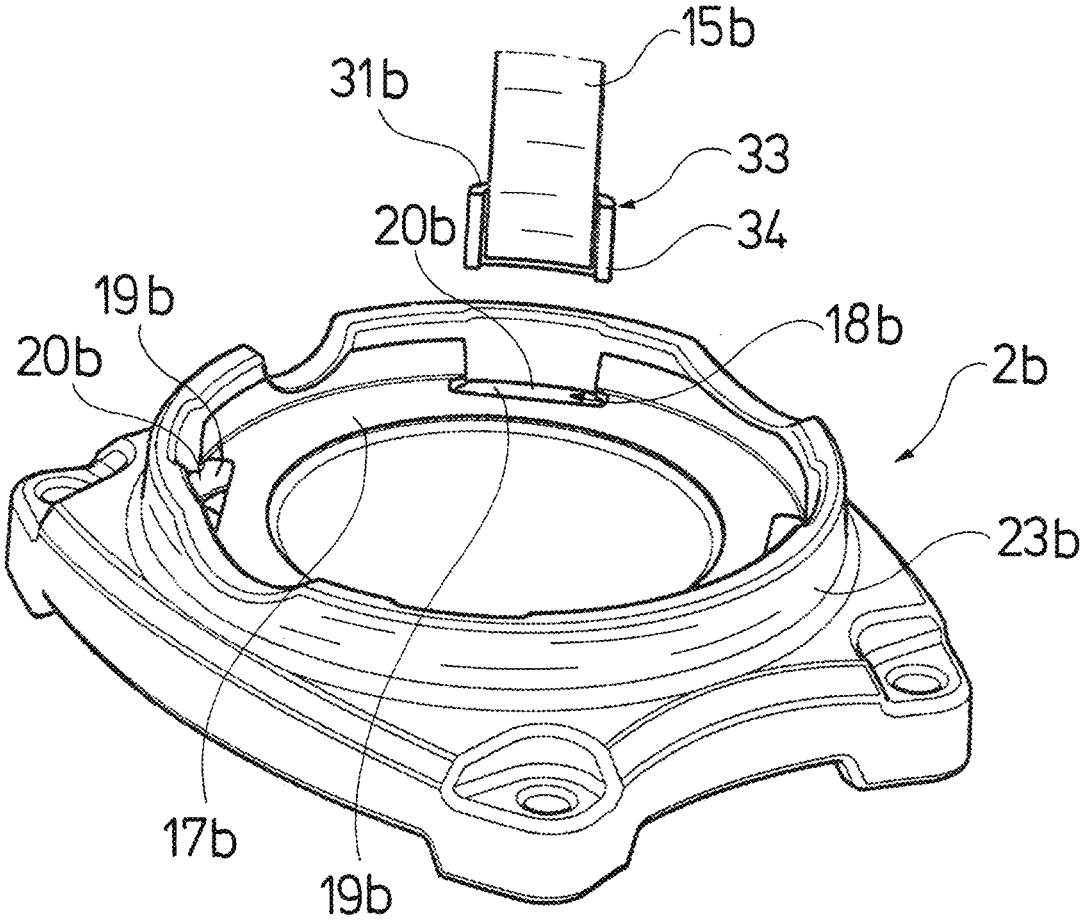
FIG. 12 is a perspective representation of an alternative embodiment of a foot part with a tie-rod end with an alternative configuration.
Figure 13:
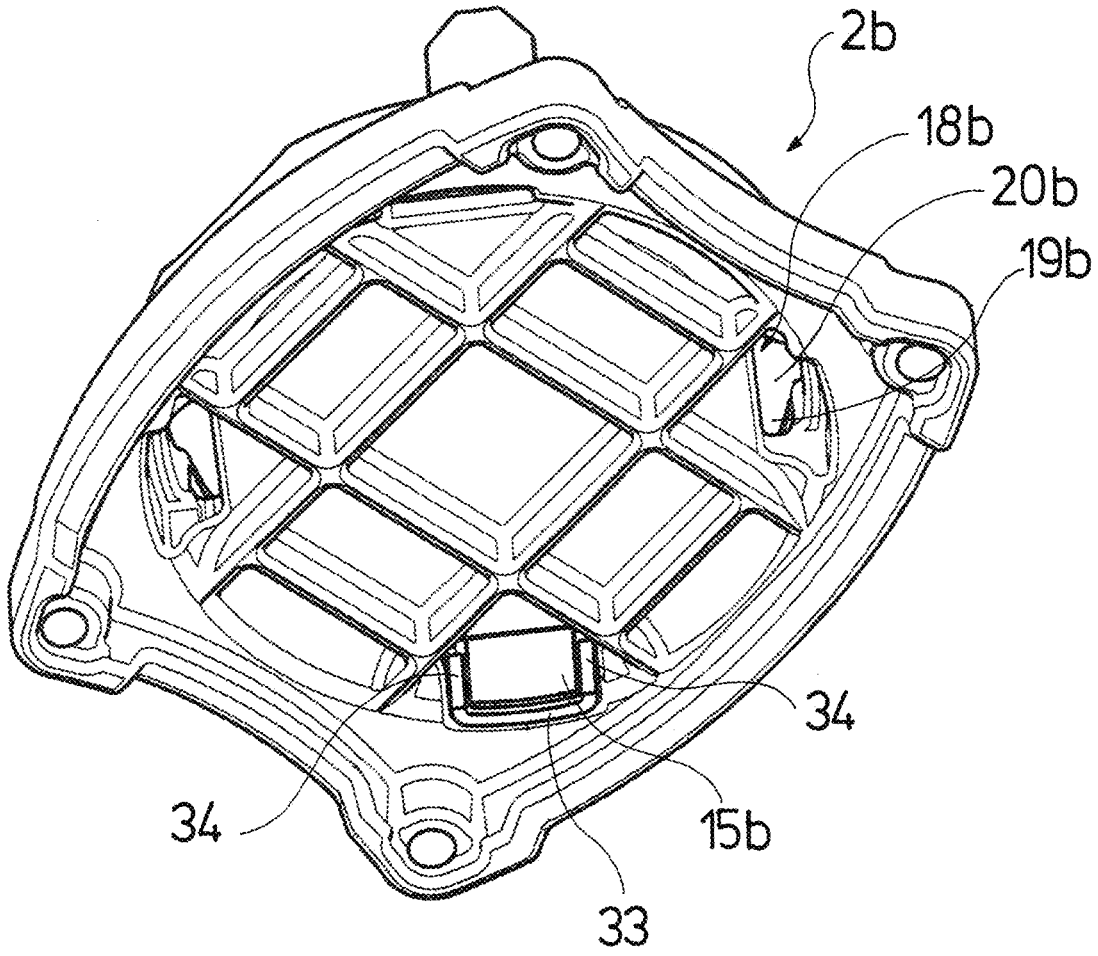
FIG. 13 is a perspective view from below of the arrangement according to FIG. 12.
Figure 18:
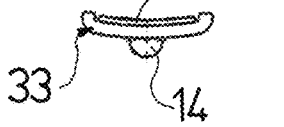
FIG. 18 is a view of the tie-rod from below.
Figure 14:
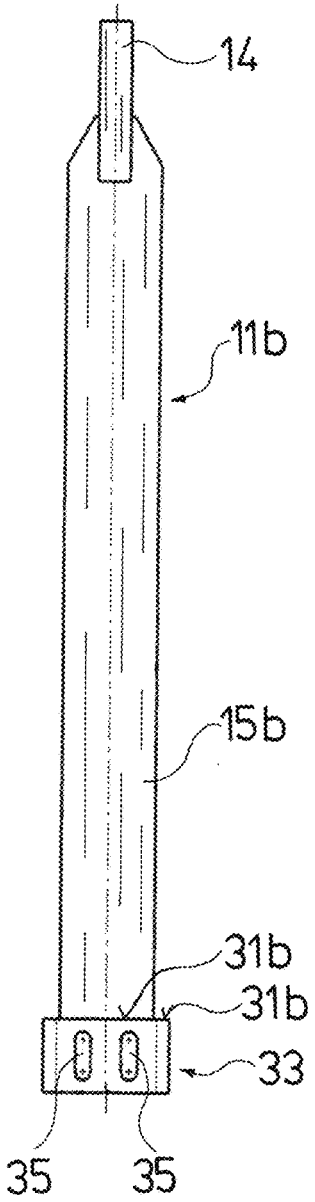
FIG. 14 is a lateral view, radially from the outside, of a tie-rod as is represented by way of FIGS. 12 and 13.
Figure 15:
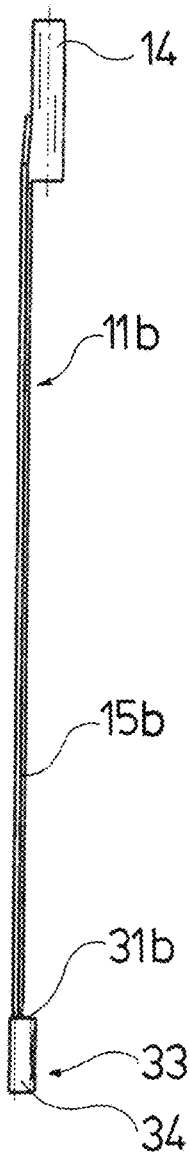
FIG. 15 is a lateral view, from the peripheral direction, of the tie-rod.
Figure 16:
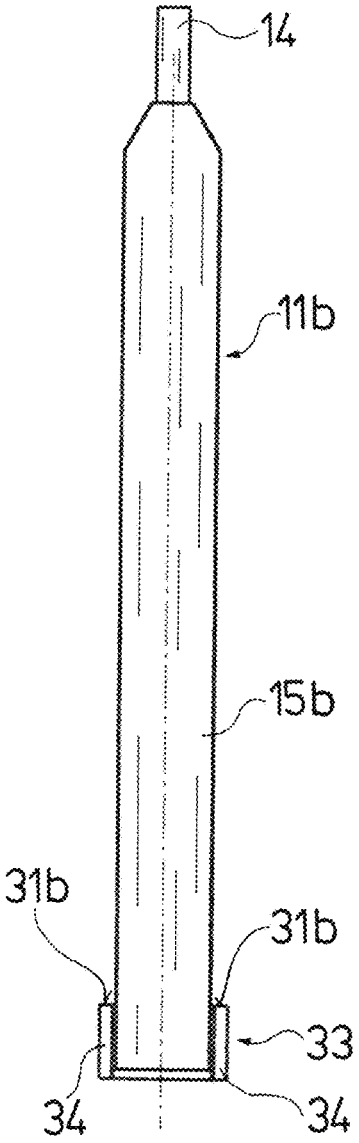
FIG. 16 is a lateral view, radially from the inside, of the tie-rod.
Figure 17:
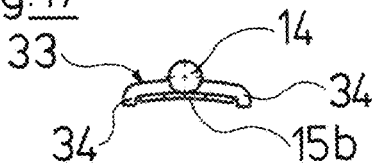
FIG. 17 is a view of the tie-rod from above.

Referring to the drawings, with regard to the centrifugal pump 1 which is represented by way of FIG. 1, it is the case of a multi-stage centrifugal pump of the inline construction type (see also FIG. 11). It comprises a foot part 2 which with its lower side is envisaged for placement on the ground or a suitable foundation. The foot part 2 essentially has the shape of a rectangular plate which at its corners comprises four fastening recesses 3, with which the foot part 2 can be screw-fastened on the foundation, in which suitable cap screws are led through these recesses 3 and are anchored in the foundation. The foot part 2 comprises a circular receiver 4, which is provided for receiving a component which comprises a suction connection 5 as well as a delivery connection 6 and which receives pumps stages connecting thereto at the top, said pump stages being closed to the top by a cover part 7. A cylindrical tube section 8 is arranged between the cover part 7 and the component receiving the suction and delivery connection 5, 6, wherein this tube section surrounds the pump stages at a distance and forms an annular channel, via which the fluid exiting at the end of the last pump stage is led to the delivery connection 6. The pump is closed to the top by a head part 9 which at the same times forms a motor stool for an electrical motor which can be flanged on there.

Figure 4:
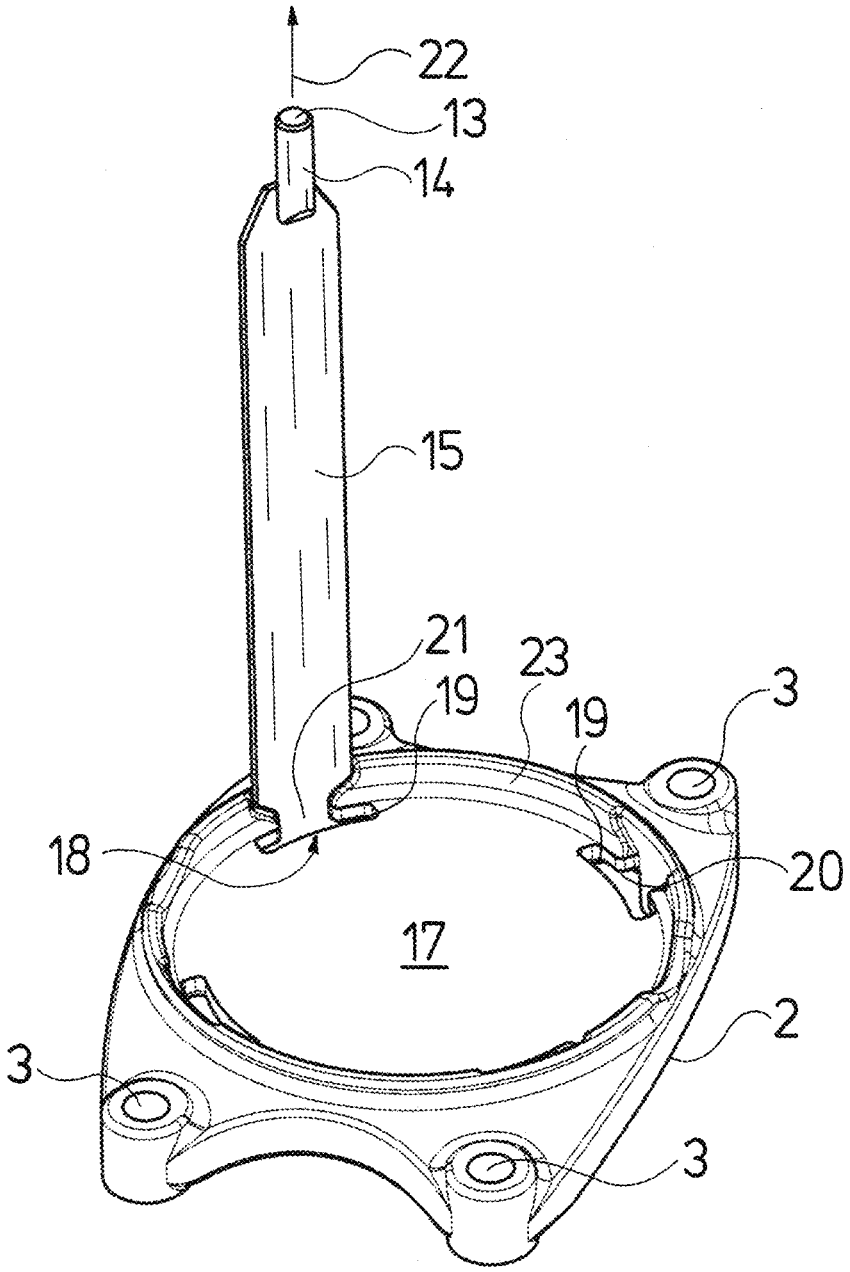
FIG. 4 is a perspective view, obliquely from above, of the arrangement according to FIG. 3.
Figure 5:
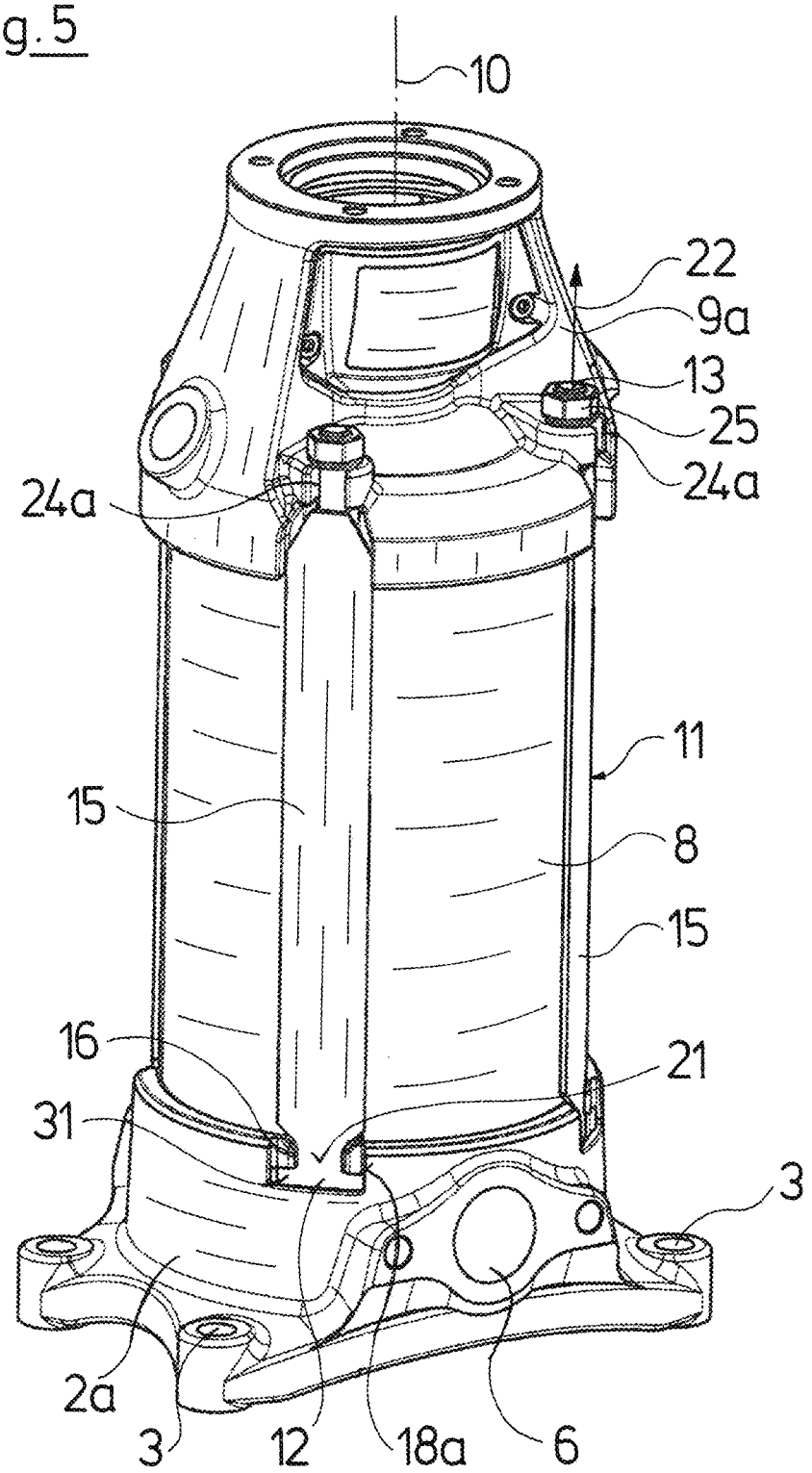
FIG. 5 is a greatly simplified perspective representation of a different embodiment example of the centrifugal pump.
Figure 6:
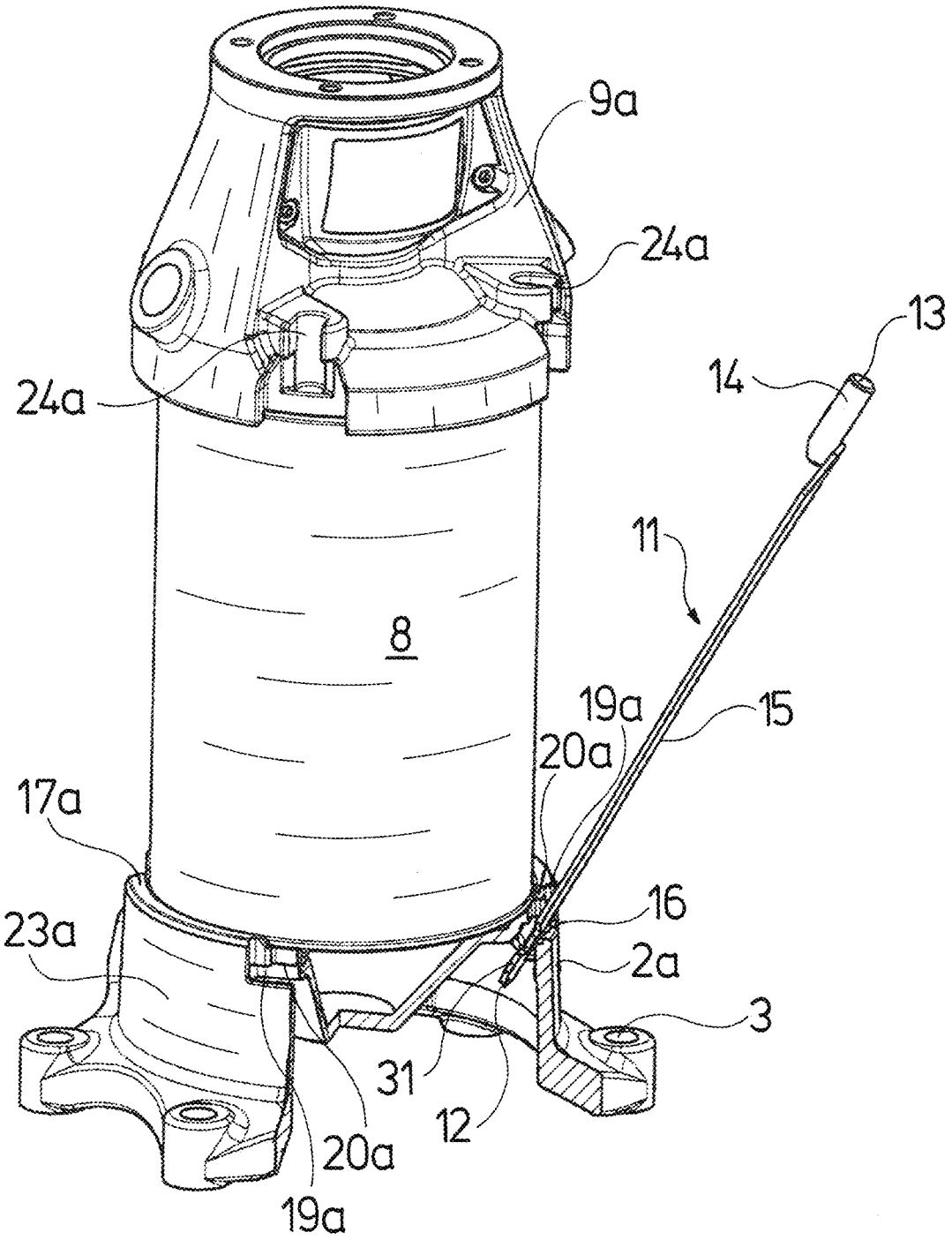
FIG. 6 is a perspective view of the pump according to FIG. 5, with a foot part in part-section and with a tie-rod in the introduction position.
Figure 7:
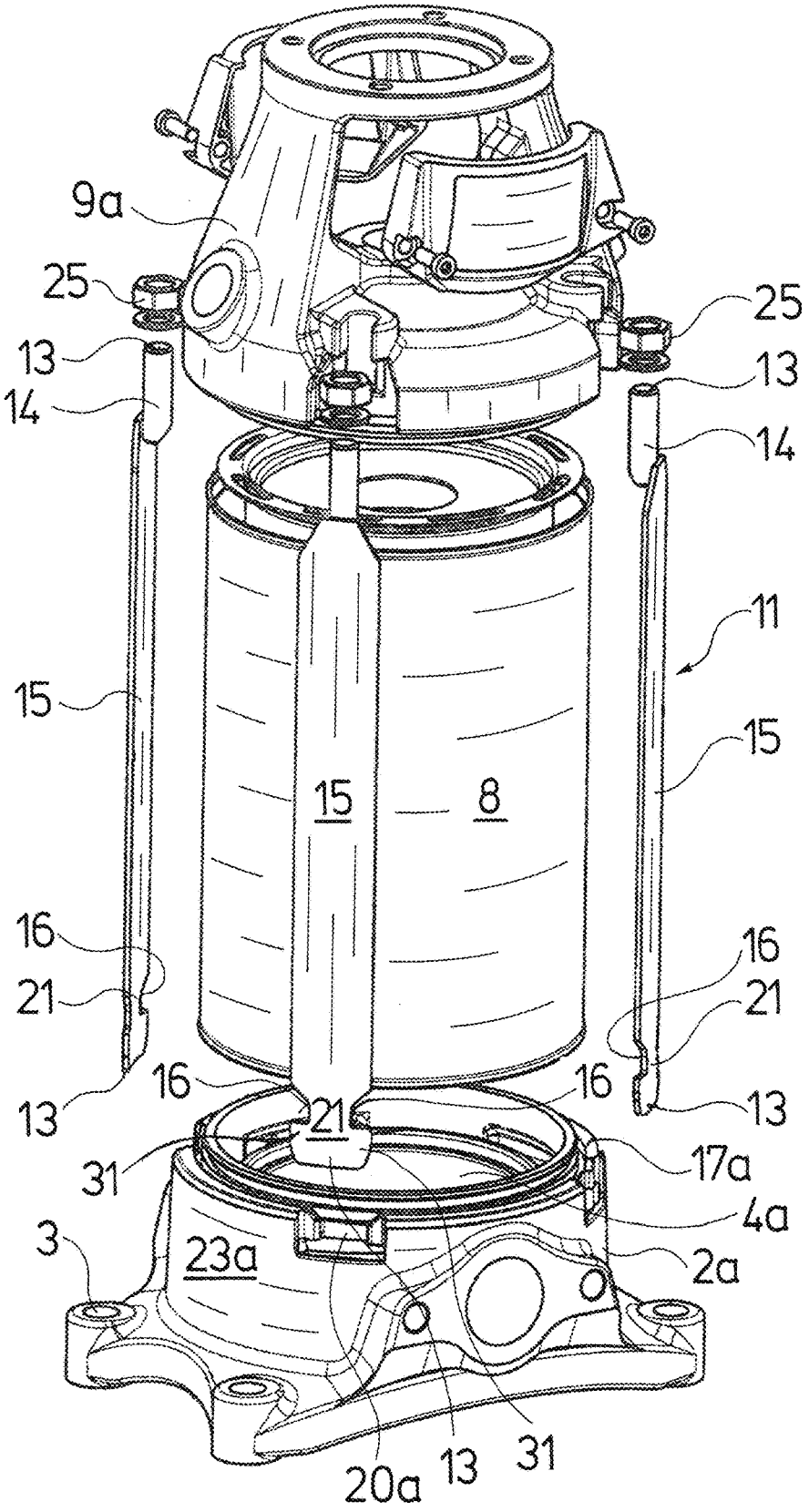
FIG. 7 is an exploded representation of the pump according to FIG. 5.
Figure 8:
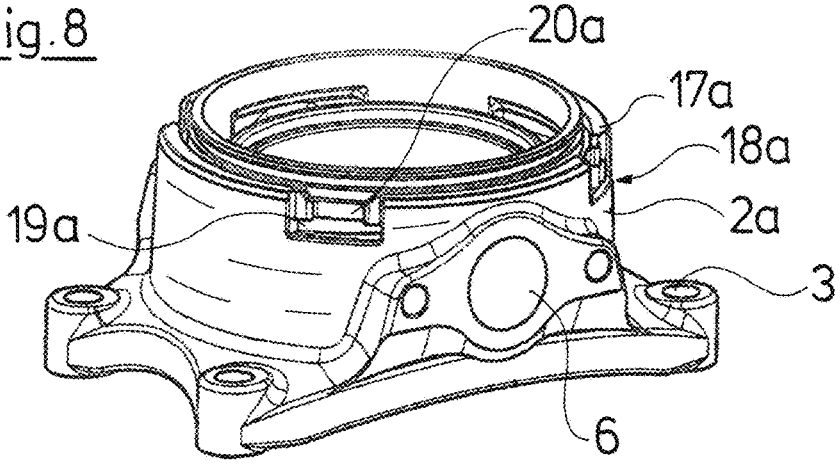
FIG. 8 is a perspective view, obliquely from the front and above, of a foot part of the pump according to FIG. 5.
Figure 9:
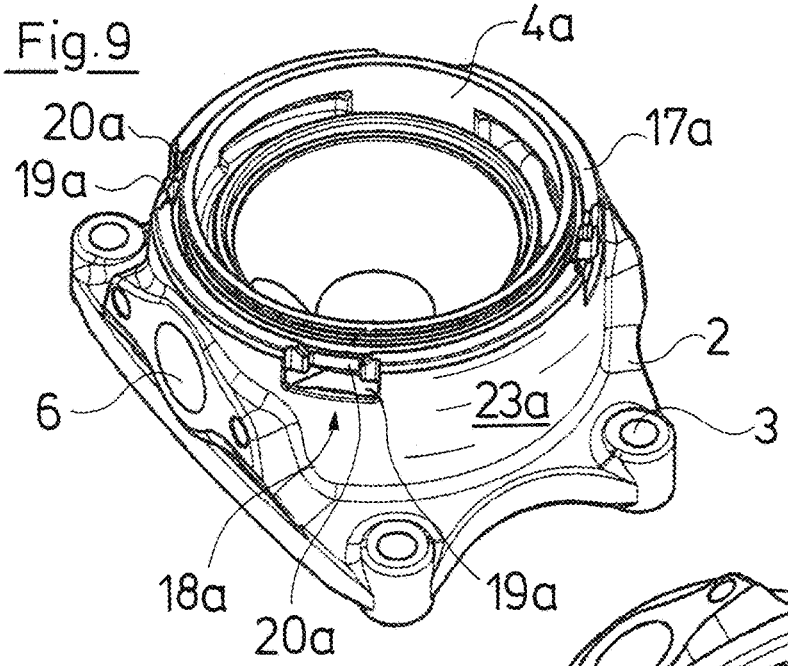
FIG. 9 is a perspective view of the foot part according to FIG. 8, in a view which is rotated by 90° with respect to FIG. 8.
Figure 10:
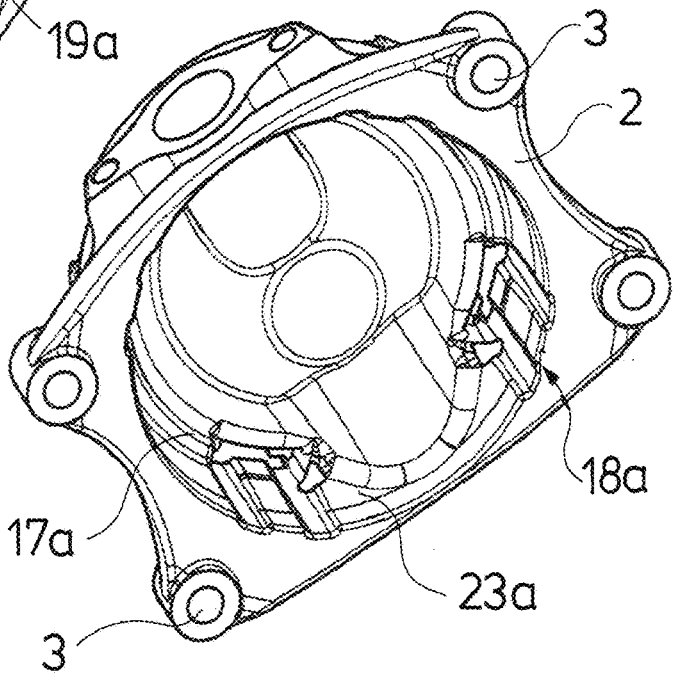
FIG. 10 is a perspective view from below of the foot part according to FIG. 8.

The component comprising the suction and delivery connection 5, 6, the pump stages which connect thereto, the tube section 8 surrounding these and the cover part 7 are positively and non-positively clamped between the foot part 2 and the head part 9, and specifically by way of four tie-rods 11 which are arranged symmetrically about the longitudinal and rotation axis 10 of the pump. These tie-rods 11 are manufactured from sheet metal and have a longitudinally extended, narrow shape and are bent about their longitudinal axis in a manner corresponding to the curvature of the tube section 8, so that these continue outwards as is evident from FIG. 1. The tie-rods 11 comprise a lower end 12 which is likewise formed from sheet metal as well as an upper end 13 which is formed by a bolt 14 which is provided with an outer thread and is fixedly connected to the upper end of the part of the tie-rod 11 which is manufactured from sheet metal, by way of welding. The sheet metal section 15 is provided with two recesses 16 on its longitudinal side, towards the lower end 12, and these recesses are arranged at the same height and their lower side is recessed inwards by 90° and their upper side tapers obliquely to the outer edge of the sheet-metal section 15. Four rod recesses 18 whose contour can be recognized best of all from FIG. 4 are provided in the foot part 2, and specifically at the edge of the receiver 4, in the axial wall 17, for anchoring these lower ends 12 of the tie-rods 11.

Each rod recess comprises an introduction part 19 as well as a holding part 20 which are matched to the lower end 12 of a tie-rod. The introduction part 19 is thus dimensioned such that it corresponds to the cross-sectional area of the sheet-metal section 15 which is to say that the tie-rod 11 with its lower end 12 and the projections 31 can be inserted from above into the introduction part 19 and led through this. This lower end 12 is inserted into the introduction part 19 so far, until the recesses 16 are arranged at the height of the rod recess 18, and thereafter the tie-rod 11 in the rod recess 18 is displaced radially outwards, so that the comparatively narrow web part 21 formed between the recesses 16 in the sheet-metal section 15 gets into the holding part 20 of the rod recess 18, by which means the tie-rod 11 is fixed in the foot part 2 with a positive fit in the tensile 22 by way of the projections 31. Thereby, the holding part 20 of the rod recess 18 which is arranged in the axial wall 17 of the recess 4 is continued in the radial wall 23 of the receiver 4 in a manner corresponding to the recesses 16 tapering obliquely upwards, so that the tie-rod in this position is arranged outside the actual receiver 4, specifically radially offset thereto.

The receiver 4 which with regard to its dimensioning is provided for receiving the component receiving the suction and delivery connection 5, 6, can receive this component after integrating the tie-rods 11, as was hitherto the case, but with the effect that the introduction parts 9 of the rod recesses 18 are closed due to the integration of the component into the receiver 4, and thus the lower ends 12 of the tie-rods 11 with their projections 31 are positively fixed within the foot part 2.

The remaining pump parts, in particular the pump stages, the tube section 8 and the cover part 7 can be integrated as soon as the tie-rods 11 are fixed positively within the foot part 2, whereupon the head part 9 is applied from the top. Thereby, the upper ends 13, thus the bolts 14 which are provided with a thread, go through hole recesses 24 into the head part 9, said hole recesses 24 being arranged in a manner aligned to the rod recesses 8 arranged in the foot part 2, so that after placing on the head part, the bolts 14 which project through the hole recesses 24, amid the intermediate arrangement of washers, are provided with nuts 25 and are tightened. The complete centrifugal pump 1 obtains a closed and stable structure by way of this, wherein, the tie-rods 11 bear on the pump body which is otherwise cylindrical there, as is evident in particular from FIG. 1, so that as a whole, a slim outer contour practically without projections in the radial direction arises.

With the embodiment variant which is represented by way of FIG. 5-10, the suction connection 5 and the delivery connection 6 are integrated into the foot part 2*a*. There, the tube section 8 which delimits the annular channel to the outside extends between the foot part 2*a* and the head part 9*a*. The construction in detail in particular is to be deduced from FIG. 7. With this design, the head and foot parts 9*a*, 2*a* which consist of cast metal are not lined with stainless steel sheet as in the previous embodiment, but form parts of the flow channels. The basic construction is similar, but the receiver 4*a* is configured in a closed manner, which is to say without recess on the inner side. This is necessary in order to ensure the sealedness with respect to the tube section 8. The rod recesses 18*a* which surround the receiver 4*a* are provided here and these are arranged at the outer side of the receiver 4*a* and comprise a radial introduction part 19*a* and an axial holding part 20*a*. The radial introduction part 19*a* of a rod recess 18*a* lies in a radial wall 23*a* which surrounds the receiver 4*a* at a distance and receives the delivery connection and the suction connection 5, 6. This radial wall 23*a* at its upper end merges in a shouldered manner into an axial wall 17*a*, but is not a part of the receiver 4*a*, but forms an outer shoulder.

The tie-rod 11 itself is configured just as in the previously described embodiment. Here however, as is to be seen in particular in FIG. 6, they are inserted obliquely from the outside and from the top through the introduction part 19*a*, thus the rod recess part in the radial wall 23*a*, until the recesses 16 or the web 21 of the tie-rods 11 are arranged at the height of the holding parts 20*a* of the rod recesses 18*a*. The tie-rod 11 is then pivoted obliquely upwards, until this is present at a distance parallel to the tube section 8, and the bolt 14 provided with a thread engages into the laterally open hole recess 24*a*, opposite whose upper end, as with the preceding embodiment, it is screwed to a nut 25 amid the integration of a washer, and thus tightened. On pivoting in the tie-rod 11, roughly about an axis running tangentially to the upper edge of the foot part 2*a*, the narrow sheet metal section 21 gets between the recesses 16 into the region of the holding part 20*a* of the rod recess 18*a* in the axial wall 17*a*, by which means the parts of the sheet metal section 15 which project with respect to this assume a positive connection in the pulling or tensile direction 22 and in the opposite direction. The tie-rods 11 are held in this position by way of the threaded bolt 14 which is fixed by way of the nut 25 and with which the upper end 14 of the tie-rod 11 is fastened on the head part 9*a*.

The holding part 20*a* of a rod recess 18*a*, with the described embodiment is provided in the axial wall 17*a*, but this part of the rod recess 18*a* can also be provided in the radial wall 23*a*, if this is dimensioned accordingly and comprises a recess or opening which is matched to the lower end 12 of the tie-rod 11, which is to say corresponds to this with regard to the shape.

The significant advantage with the previously described arrangement lies in the fact that the pump can be constructed quasi in a complete manner starting from the foot part 2*a* up to the head part 9*a*, whereupon the tie-rods 11 are subsequently introduced into the rod recesses 18*a* and are secured there with a positive fit by way of pivoting. The respective tension between the foot part 2*a* and the head part 9*a* is then incorporated by way of tightening the nut 25 with the envisaged torque. This construction type is therefore particularly suitable for an at least part-automated assembly.

The basic construction of such a centrifugal pump with a drive is represented by way of FIG. 11, and this, as the horizontal interrupt lines illustrate, is to represent multistage centrifugal pumps with a quasi infinite pump stage number. A drive motor 26 in the form of an electric motor is attached on the head part 9*a* which at the upper end is configured as a motor stool, for the drive of the centrifugal pump, wherein the shaft 27 of the electric motor is connected in a rotationally fixed manner to a shaft 28 of the centrifugal pump 1 by way of a coupling. Impellers 29 are arranged on the drive shaft 28 of the centrifugal pump in a rotationally fixed manner according to the stage number and together with diffusers 30 fixed with regard to the casing form the pump stages.

The delivery fluid is led via the suction connection 5 (not visible in FIG. 11) to the suction port of the lowermost pump stage, and from there goes from pump stage to pump stage amid a pressure increase to the top where it exists within the head part 9*a* and is led via an annular channel 31 back down again to the foot part and there to the delivery connection 6.

An alternative design of the tie-rods 11*b* is represented by way of FIGS. 12 to 18, said design differing from that of the aforementioned tie-rods 11 in that the sheet metal section 15*b* has a constant cross section over the entire length, thus is not weakened by lateral recesses. A threaded bolt 14 is welded to the upper end in the same manner as the previously described embodiment. However, the projection 31*b* at the lower end is formed by a sheet metal section 33 which has an essentially U-shaped cross section, is adapted in the web region to the curvature of the sheet metal section 15*b* and whose U-limb 34 laterally surround the end of the sheet metal section 15*b*, so that a partly peripheral projection 31*b* results, said projection being formed on the radial outer side of the sheet-metal section 15*b* in the web region of the U-shaped sheet-metal section 33 as well as in the peripheral directions by way of the limbs 34. The sheet metal section 33 comprises two elongate-hole-shaped openings 35 which extend in the longitudinal direction of the tie-rod 11*b* and are arranged parallel to one another (see FIG. 14). These openings 35 serve for incorporating a weld seam between the sheet-metal section 33 and the sheet metal section 15*b* and ensure a uniform introduction of force from the sheet metal section 33 onto the sheet metal section 15*b*. As is evident from FIG. 16, the sheet metal section 15*b* is not led completely up to the lower end of the sheet metal section 33, by which means the effective length of the tie-rod 11*b* is not set until welding on the sheet metal section 33.

The foot part 2*b* is provided for the positive anchoring of the lower ends of the tie-rods 11*b*, said foot part with regard to its basic construction corresponding essentially to the foot part 2 of the first embodiment, but with regard to the rod recesses 18*b* being adapted to the lower ends of the tie-rods 11*b*, particular with regard the projections 31*b*. The rod recesses 18*b* are configured such that the axial wall 17 comprises rod recesses 18*b* which are configured such that the lower end of the sheet metal section 15*b* can be led with the sheet metal section 33 which is welded thereto, through an introduction part 19*b* and then displaced radially outwards, in a manner such that the sheet metal section 15*b* passes through the holding part 20*b* of the rod recess 18*b*, but the sheet metal section 33 which forms the projection 31*b* is positively held, and specifically by the lower face side of the radial wall 23*b*, on which the sheet metal section 15*b* bears. Herein, with this embodiment too, it is the case that the component which is then integrated with the tube section 8 and which comprises the delivery connection 6 and the suction connection 5 positively holds the ends of the tie-rods 11*b* in this position, in which the projections 31*b* positively fix the tie-rods to the foot part 2*b* in the tensile direction.

With regard to the tie-rods 11*b*, this embodiment compared to the aforementioned one has the advantage that with regard to their cross section, i.e. with regard to their width and thickness, they can be dimensioned exclusively in the light of the expected tensile forces, whereas the projections 31*b* are formed by the separate sheet metal sections 33 which are each connected to the sheet metal section 15*b* by way of welding.

Figure 19:
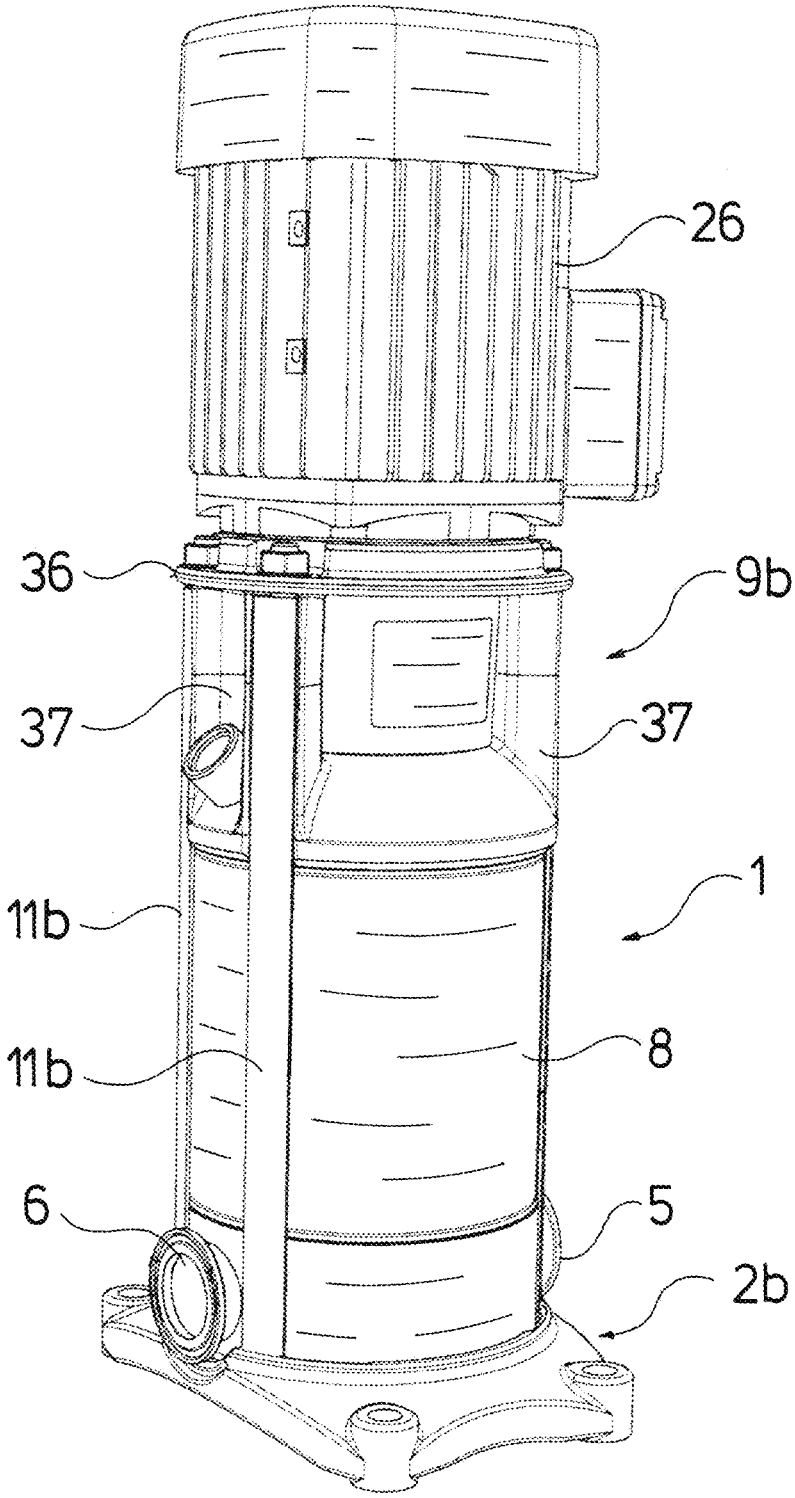
FIG. 19 is a perspective representation of an alternative design of a pump assembly with a drive motor, concerning which the tie-rods are led through to the motor stool.

A design variant, concerning which the head part 9*b* which simultaneously forms the motor stool is configured such that an outer flange 36 is formed at the motor stool side is represented by way of FIG. 19, said outer flange being dimensioned in a manner such that the tie-rods 11*b* can be led through upwards to into this flange, where they are fixed with their threaded bolts 14 by way of nuts in a manner such that the pump stages with the tube section 8 and with the component which receives the suction and delivery connection 5, 6 are clamped between the head part 9*b* and the foot part 2*b*. In order to provide the sheet metal sections 15*b* of the tie-rods 11*b* with a sufficient stability in the region of the head part 9*b*, comparable to the bearing contact on the tube section 8, supports 37 are provided there, and these supports extend between the part of the head part 9*b* which connects directly onto the tube section 8 and the flange 36, and on which supports the tie-rods 11*b* bear on this region and are supported radially to the inside.

It is to be understood that this embodiment variant according to FIG. 19 is not limited to the represented tie-rods 11*b* in combination with the foot part 2*b*, but that here the previously described tie-rods and foot part designs can also be applied as an alternative.

While specific embodiments of the invention have been shown and described in detail to illustrate the application of the principles of the invention, it will be understood that the invention may be embodied otherwise without departing from such principles.

The invention claimed is:

1. A multi-stage centrifugal pump comprising:

a foot part;

a head part;

pump stages integrated between the foot part and the head part, said pump being designed as an inline pump;

a suction connection and a delivery connection in the foot part, wherein the pump stages are surrounded by an annular channel, by way of which a last pump stage is connected to the delivery connection, the annular channel having an outer channel wall;

tie-rods arranged on the outer channel wall, said tie-rods connecting the head part and the foot part to one another, each of the tie-rods being fixed with one end to the head part and with another end to the foot part, wherein the tie-rods each comprise a thread end, with which thread end the tie-rods are tightened on the head part or on the foot part and the tie-rods comprise at least one sheet metal section, one of the foot part and the head part comprising a plurality of fixing projections, each of the tie-rods comprising at least one recess in the at least one sheet metal section at the another end, wherein each of the tie-rods is positively fixed on the one of the foot part and the head part at least in a pulling direction via one of the fixing projections extending into the at least one recess.

2. The centrifugal pump according to claim 1, wherein the tie-rods at the other end each comprise at least one tie-rod projection positively fixing the other end to the foot part or to the head part, at least in a tensile direction, the pulling direction being parallel to a longitudinal axis of the head part, the tensile direction defining a radial direction relative to the longitudinal axis of the head part.

3. The centrifugal pump according to claim 2, wherein the tie-rod projection is formed by a sheet metal part which is connected to a part of the tie-rod formed from sheet metal, by way of welding, the tie-rod projection being located adjacent to the recess.

4. The centrifugal pump according to claim 3, wherein the sheet metal part which forms the tie-rod projection surrounds the part of the tie-rod which is formed from sheet metal, in a U-shaped configuration and comprises at least one opening for receiving a weld seam.

5. The centrifugal pump according to claim 2, wherein the tie-rod projection is arranged in a peripheral direction of the annular channel wall and further comprising another tie-rod projection wherein two projections are arranged in opposite peripheral directions.

6. The centrifugal pump according to claim 2, wherein the at least one tie-rod projection is arranged in a peripheral direction of the annular channel wall and is formed by an edge recess in the sheet metal, said at least one tie-rod projection projecting in a peripheral direction with respect to the edge recess.

7. The centrifugal pump according to claim 6, wherein the tie-rods each comprise an edge recess on both longitudinal sides, said edge recesses being arranged at the same height.

8. The centrifugal pump according to claim 1, wherein each thread comprises a threaded bolt which by way of welding is connected to the sheet metal section of the tie-rod.

9. The centrifugal pump according to claim 1, wherein hole recesses are provided in the head part, through which hole recesses the thread ends of the tie-rods are led and are fixed and tightened in each case by way of a nut, wherein the head part comprises a motor support.

10. The centrifugal pump according to claim 1, wherein the outer channel wall comprises a cylindrical wall section in the region of the annular channel, between the foot part and the head part comprises a surface with a curvature and the at least one sheet metal section of the tie-rods comprises a curvature which is adapted to the curvature of the cylindrical wall section.

11. The centrifugal pump according to claim 2, wherein rod recesses which comprise an introduction part and a holding part are provided in the foot part, wherein the introduction part is configured such that an end of the tie-rod can be led through, and the holding part is configured such that the end of the tie-rod can be brought with the at least one tie-rod projection into the holding part by way of radially displacing or by way of pivoting or by way of both radially displacing and pivoting, such that the tie-rod is positively held at least in a direction of a pump longitudinal axis, the introduction part comprising an introduction part width, the holding part comprising a holding part width, the introduction part width being greater than the holding part width.

12. The centrifugal pump according to claim 11, wherein the rod recesses are arranged in the foot part in a circular configuration around the pump longitudinal middle axis and introduction parts are covered by a component of the pump for the positive fixation of the tie-rods.

13. The centrifugal pump according to claim 11, wherein the holding parts connect radially outwards onto the introduction parts of the rod recesses, and a cylindrical section of the component positively fixes the ends of the tie-rods in the rod recesses.

14. The centrifugal pump according to claim 11, wherein the rod recesses are arranged in an axial wall of the foot part.

15. The centrifugal pump according to claim 11, wherein the introduction parts of the rod recesses are arranged in a radial wall and the holding parts of the recesses are arranged in an axial or radial wall of the foot part.

16. The centrifugal pump according to claim 1, wherein both the head part and the foot part or the head part or the foot part is configured as a metal cast part, wherein the foot part is configured for placing the pump on a support surface and the head part is configured for receiving an electric motor which drives the pump.

17. The centrifugal pump according to claim 1, wherein the at least one sheet metal section extends at least from the foot part up to the head part.

18. The centrifugal pump according to claim 11, wherein the foot part comprises a pot-shape structure and the rod recesses are arranged in the region, in which the pot base merges into the pot wall.

19. The centrifugal pump according to claim 1, further comprising:

a plurality of supports, wherein the at least one sheet metal section is radially inwardly supported in a region of the head part by the supports.

20. A multi-stage centrifugal pump comprising:

a foot part comprising a suction connection and a delivery connection;

a head part;

a plurality of pump stages integrated between the foot part and the head part, the pump stages being surrounded by an annular channel, wherein a last pump stage is connected to the delivery connection via the annular channel, at least a portion of the annular channel being defined by an outer channel wall;

a tie-rod arranged opposite the outer channel wall, the head part being connected to the foot part via at least the tie-rod, the tie-rod comprising a first end portion and a second end portion, the first end portion comprising a tie-rod projection, the second end portion comprising a threaded end portion, the second end portion being fixed to one of the head part and the foot part, wherein another one of the head part and the foot part comprises a fixing projection, the tie-rod comprising at least one sheet metal section, the at least one metal section comprising a first metal section portion and a second metal section portion, the tie-rod projection comprising a tie-rod projection portion, the first metal section portion being located between the tie-rod projection portion and the second metal section portion, wherein each of the tie-rod projection portion and the second metal section portion extends to a position located radially beyond the first metal section portion with respect to a longitudinal axis of the tie-rod, the tie-rod projection portion, the first metal section portion and the second metal section portion defining a recess, at least a portion of the fixing projection being arranged in the recess to positively fix the first end portion to the another one of the head part and the foot part.

* * * * *